US006872424B2

(12) United States Patent
Linford et al.

(10) Patent No.: US 6,872,424 B2
(45) **Date of Patent: *Mar. 29, 2005**

(54) DURABLE FINISHES FOR TEXTILES

(75) Inventors: Matthew R. Linford, Orem, UT (US); David S. Soane, Piedmont, CA (US); David A. Offord, Castro Valley, CA (US); William Ware, Jr., Portola Valley, CA (US)

(73) Assignee: Nano-Tex, LLC, Emeryville, CA (US)

( * ) Notice: Subject to any disclaimer, the term of this patent is extended or adjusted under 35 U.S.C. 154(b) by 301 days.

This patent is subject to a terminal disclaimer.

(21) Appl. No.: 10/093,175

(22) Filed: Mar. 6, 2002

(65) Prior Publication Data

US 2002/0160675 A1 Oct. 31, 2002

Related U.S. Application Data

(63) Continuation of application No. PCT/US00/24692, filed on Sep. 8, 2000.

(60) Provisional application No. 60/153,393, filed on Sep. 10, 1999, and provisional application No. 60/195,921, filed on Apr. 10, 2000.

(51) Int. Cl.[7] ..... B05D 3/02

(52) U.S. Cl. ..... 427/389.9; 427/393.4; 524/520

(58) Field of Search ..... 442/79, 82, 93, 442/94, 102; 427/385.5, 387, 389.9, 393.4; 524/460, 524; 525/200

(56) References Cited

U.S. PATENT DOCUMENTS

| | | | | |
|---|---|---|---|---|
| 2,670,265 | A | 2/1954 | Heyna et al. | |
| 3,231,498 | A | 1/1966 | de Vries | 252/56 |
| 3,606,992 | A | 9/1971 | Aldrich | 8/115.6 |
| 3,606,993 | A | 9/1971 | Arthur, Jr. et al. | 8/116 |
| 3,731,411 | A | 5/1973 | Barber et al. | 38/144 |
| 3,865,621 | A | 2/1975 | Dobinson et al. | 117/141 |
| 3,897,208 | A | 7/1975 | Shay | 8/187 |
| 3,914,229 | A | 10/1975 | Martin et al. | 260/256.4 F |
| 3,965,072 | A | 6/1976 | Markiewitz | 260/77.5 C |
| 3,981,913 | A | 9/1976 | Markiewitz | 260/553 R |
| 4,148,770 | A | 4/1979 | Stahle et al. | 260/27 BB |
| 4,152,115 | A | 5/1979 | Silbert et al. | 8/121 |
| 4,323,624 | A | 4/1982 | Hunsucker et al. | 428/270 |
| 4,551,350 | A | 11/1985 | Martin et al. | 427/389.9 |
| 4,987,190 | A | 1/1991 | Keogh | 525/193 |
| 5,300,569 | A | 4/1994 | Drake et al. | 525/78 |
| 5,755,828 | A | 5/1998 | Westland | 8/185 |
| 6,048,587 | A | 4/2000 | Estrin | 427/496 |
| 6,379,753 | B1 | 4/2002 | Soane et al. | 427/434.2 |
| 6,380,336 | B1 | 4/2002 | Soane et al. | 526/245 |
| 2003/0104134 | A1 * | 6/2003 | Linford et al. | 427/385.5 |

FOREIGN PATENT DOCUMENTS

| | | |
|---|---|---|
| EP | 0 648 887 | 4/1995 |
| EP | 0 651 088 | 5/1995 |
| WO | WO 99/39039 | 8/1999 |
| WO | WO 99/49124 | 9/1999 |
| WO | WO 99/49125 | 9/1999 |
| WO | WO 01/18303 | 3/2001 |
| WO | WO 01/18305 | 3/2001 |
| WO | WO 01/53366 | 7/2001 |

OTHER PUBLICATIONS

U.S. Appl. No. 09/586,185, filed Jun. 1, 2000.

U.S. Appl. No. 09/761,660, filed Sep. 27, 2000.

U.S. Appl. No. 10/059,657, filed Jan. 29, 2002, [AVNT001P2D].

U.S. Appl. No. 10/093,174, filed Mar. 6, 2002, [AVNT005/15PP].

U.S. Appl. No. 10/165,474, filed Jun. 7, 2002, [AVNT001P1D2].

* cited by examiner

*Primary Examiner*—Arti R. Singh
(74) *Attorney, Agent, or Firm*—Burns Doane Swecker & Mathis LLP

(57) ABSTRACT

The present invention relates to textile treatment compositions for imparting desirable characteristics durably to textile fibers and fabrics, including softness, hydrophobicity, oleophobicity, surface lubricity, abrasion resistance, tear resistance, improved drape, and pilling resistance. More particularly, in one embodiment, the invention is directed to preparations that comprise a carboxylate-functionalized fluorinated polymer and a catalyst that is capable of forming reactive anhydride rings between carboxyl groups on the polymer. In another embodiment, the invention is directed to preparations comprising a polymeric softener having at least one anhydride functional group or at least one reactive group capable of forming an anhydride functional group, together with a catalyst for forming anhydrides from the reactive group or groups. In either embodiment, the resulting reactive anhydride rings bind to substrates, such as textiles and other webs, having free sulfhydryl, alcohol, or amine groups. The invention is further directed to the process for treating textiles and other webs with desirable finishes durable to repeated cleanings. This invention is further directed to the yarns, fibers, fabrics, textiles, finished goods, or nonwovens (encompassed herein under the terms "textiles" and "webs") treated with the textile-reactive preparations of the invention. Such textiles and webs exhibit a greatly improved, durable characteristics, such as softness and/or hydrophobicity, even after multiple launderings.

6 Claims, No Drawings

DURABLE FINISHES FOR TEXTILES

The present invention is a continuation of co-pending International Patent Appln. No. PCT/US00/24692, filed Sep. 8, 2000 and designating the United States of America, which application claims the benefit of Provisional U.S. application Ser. No. 60/153,393, filed Sep. 10, 1999 and of Provisional U.S. application Ser. No. 60/195,921, filed Apr. 10, 2000; the entire disclosures of all of which are incorporated herein by reference.

FIELD OF THE INVENTION

The present invention relates to textile treatment compositions for imparting durable desirable characteristics to textile fibers and fabrics, such as softness, hydrophobicity, oleophobicity, surface lubricity, abrasion resistance, tear resistance, improved drape, and pilling resistance.

BACKGROUND OF THE INVENTION

Two methods of imparting hydrophobic character to textiles have been investigated in the past: 1) hydrophobic polymer films, and 2) attachment of hydrophobic monomers and polymers via physi- or chemisorptive processes.

Current commercial processes for producing water-repellent/soil-resistant fabrics are mainly based on the laminating processes of companies such as W. L. Gore and Sympatex (*Journal of Coated Fabrics* vol. 26, 1996, pp. 107–130) and polysiloxane coatings (*Handbook of Fiber Science and Technology*, Marcel Dekker, New York, N.Y., Vol. II, 1984, pp. 168–171). The laminating process involves adhering a layer of polymeric material (such as Teflon™ that has been stretched to produce micropores) to a fabric. Although this process produces durable repellent films, it suffers from many disadvantages. The application of these laminants requires special equipment and therefore cannot be applied using existing textile production processes. Synthesis of the film is costly and garments with this modification are significantly more expensive than their unmodified counterparts. The colors and shades of this clothing are limited by the coating color. Finally, clothing made from this material tends to be heavy and stiff. Polysiloxane films suffer from low durability to laundering, which tends to swell the fabric and rupture the silicone film. The polysiloxanes have a cost advantage over the laminates, which are, however, more durable to laundering and dry-cleaning.

Repellents based on monomeric hydrocarbon hydrophobes can be broken down into five categories: 1) aluminum and zirconium soaps, 2) waxes and waxlike substances, 3) metal complexes, 4) pyridinium compounds, 5) methylol compounds, and 6) other fiber-reactive water repellents. Compared to polymeric coatings, monomeric hydrophobes can penetrate within the fabric to produce a more durable coating.

The oldest and most economical way to make fabric water repellent is to coat it with a hydrophobic substance, such as paraffin (*Text. Inst. Ind.* vol.4, 1966, p. 255). This process is still in practice today and paraffin emulsions for coating fabrics can be purchased (e.g., Freepel® from BFGoodrich Textile Chemicals, Inc.). Waxes are not stable to laundering or dry cleaning. Durability is poor due to their noncovalent nature of binding and their breathability is low.

One of the oldest water repellents was based on noncovalently applying water-soluble soap to the fibers and precipitating it with an aluminum salt (*J. Text Res.* vol. 42, 1951, p. 691). These coatings dissolved in alkaline detergent solution, therefore washfastness was poor. Zirconium soaps were less soluble in detergent solutions (*Waterproofing and Water-Repellency*, Elsevier Publ. Co., Amsterdam, 1963, p. 188), but due to the noncovalent nature of attachment to the fabric, abrasion resistance was poor.

Quilon chrome complexes polymerize to form —Cr—O—Cr— linkages (*Tappi* vol. 36, 1953, p. 107). Simultaneously, the complex forms covalent bonds with the surface of fibers with hydrophobic chains directed away from the surface to produce a water repellent, semi-durable coating. Quilon solutions require acidic conditions to react, thus causing degradation of the cellulose fibers through cellulose hydrolysis. Fabric colors are limited by the blue-green coloration imparted by the metal complex.

The extensive history of pyridinium-type water repellents has been reviewed by Harding (*J. Text. Res.* vol. 42, 1951, p. 691). In essence, an alkyl quaternary ammonium compound is reacted with cellulose at elevated temperatures to form a durable water-repellent finish on cotton (Br. Pat. 466,817) and a later version was marketed under the trademark Velan PF by ICI. It was later found that the reaction was restricted to the surface of the fibers (*J. Soc. Dyers Colour.* vol. 63, 1947, p. 260) and the high cure temperature weakened the fabric. Sodium acetate had to be added to prevent the decomposition of the cellulose by the HCl formed. Also, the pyridine liberated during the reaction has an unpleasant odor and the fabric had to be scoured after the cure. The toxicological properties of pyridine ended its use in the 1970s when government regulations on such substances increased.

Methylol chemistry has been extensively commercialized in the crosslinking of cellulose for durable press fabrics. N-methylol compounds are prepared by reaction of an amine or amide with formaldehyde. Alkyl-N-methylol compounds can be reacted at elevated temperatures in the presence of an acidic catalyst with the hydroxyl groups of textiles to impart durable hydrophobic qualities (Br. Pats. 463,300 and 679, 811). The reaction is accompanied by formation of noncovalently linked (i.e., non-durable) resinous material, thus decreasing efficiency. In addition, the high temperature and acid catalyst reduce the strength of the fabric. Recently, the commercial use of methylol compounds has been waning due to concerns of toxic formaldehyde release from fabrics treated in such a manner.

Several other chemical reactions have been used to covalently attach hydrophobic species to cotton to produce a water-repellent finish but have not been commercialized for various reasons. Long-chain isocyanates have been used in this respect (Br. Pat. 461,179; *Am. Dyest. Rep.* vol. 43, 1954, p. 453; Br. Pat. 474,403). The high toxicity of isocyanates and significant side reactions with water, however, precluded it from commercial use. To circumvent the water sensitivity of isocyanates, alkyl isocyanates were reacted with ethylenimine to yield the less reactive aziridinyl compound, which was subsequently reacted with cellulose at 150° C. (Ger. Pat. 731,667; Br. Pat. 795,380). Although the toxicity of the aziridinyl compound was reduced compared to the isocyanate, the procedure still required the handling of toxic isocyanate precursors. Also, the high cure temperature weakened the cellulose, and crosslinkers were needed to increase structural stability. Alkyl epoxides can be reacted with cellulose under acidic or basic conditions to produce durable, water-repellent cotton (Ger. Pat. 874,289). The epoxide was applied from a volatile solvent to suppress side reactions with water. Epoxides are, in general, not very reactive, thus requiring long reaction times at high temperatures. Therefore, they have not been commercialized. Acylation of cotton with isopropenyl stearate from an acidic solution of benzene and curing at 200° C. produced a durable hydrophobic coating (U.S. Pat. No. 4,152,115). The high cure temperature and acid catalyst again weakened the cotton. Carcinogenic benzene can be replaced by toluene, but the practicality of using flammable solvents in fabric finishing is limited. Alkyl vinyl sulfones react with cellulose in the presence of alkali to form a repellent finish (U.S. Pat. No. 2,670,265). However, this method has not been commercialized because the alkali is not compatible with crosslinking reactants required for permanent press treatments.

Conventional softeners improve the hand of the fabric as well as increase abrasion resistance and tear strength. The softener also functions as a sewing lubricant. There are four basic types of softeners—anionic, cationic, nonionic, and blended systems.

The anionic softeners are generally sulfated or sulfonated compounds used primarily to lubricate yarns through processing. Examples of these compounds include sulfonated tallow, glycerides, and esters. Sulfonated or sulfated castor oil, propyl oleate, butyl oleate, and tallow are used in various steps in dying fabrics. Anionics tend to provide inferior softness compared to the cationics and nonionics. Furthermore, they have limited durability to laundering or dry-cleaning. Their major limitation comes from their negative charge, which causes incompatibility in resin finishing baths and makes them most sensitive to water hardness and electrolytes.

The cationic softeners are nitrogen-containing compounds including fatty amino amides, imidazolines, amino polysiloxanes, and quaternaries. As a result of their positive charge, they are attracted to cotton or synthetic fabrics through electrostatic interactions. They tend to be compatible with most resin finishes and are somewhat durable to laundering. The most significant disadvantage of cationic softeners is their tendency to change the shade or affect the fastness of certain dyestuffs. Discoloration on white fabrics may also be a concern. The development of a fishy odor on the fabric can be a problem with certain systems.

Nonionics are the most widely used softeners. This class includes polyethylenes, glycerides such as glycerol monostearate, ethoxylates such as ethoxylated castor wax, coconut oil, corn oil, etc., and ethoxylated fatty alcohol and acids. The nonionic softeners offer excellent compatibility in resin baths due to their unreactivity. Since nonionics have no charge, they have no specific affinity for fabrics and therefore have relatively low durability to washing.

To optimize softening and lubricating properties, many manufacturers tend to formulate a softener containing both nonionic and cationic types. Typically, an aminosilicone or an imidazoline for a silky soft slick hand will be blended with a cationic or nonionic polyethylene lubricant for sewability and tear- and abrasion-strength properties. Increased customer demand for improved durability and useful life of a garment has led to the use of high-density polyethylenes as softeners. These have decreased solubility and thus are more durable. However, the disadvantages of the softeners (such as, for example, lack of durability to repeated launderings) remain.

The benefits of using the permanent modifying agent described below include durability of the treatment by providing covalent chemical attachment to the substrate. Additionally, the chemical nature of the modifier is compatible with other treatment formulations including, for example, water- or oil-repellent finishes and wrinkle-resistant treatments.

References: *Handbook of Fiber Finish Technology*, Philip E. Slade, Marcel Dekker, Inc., New York, 1998; *Wellington Sears Handbook of Industrial Textiles*, Sabit Adanur, Technomic Publishing, 1995, Pennsylvania; *Cotton Dyeing and Finishing: A Technical Guide*, Cotton Incorporated, North Carolina, 1996.

SUMMARY OF THE INVENTION

This invention is directed to treatment preparations useful for the treatment of textiles and other webs to provide durable water and soil repellency, soft hand or other desirable characteristics to keratinous and/or cellulosic textiles and other webs.

More particularly, a first embodiment of the invention is directed to preparations that comprise a carboxylate-functionalized fluorinated polymer and a catalyst that is capable of forming reactive anhydride rings between carboxyl groups on the polymer. The resulting reactive anhydride rings bind to substrates, such as textiles and other webs. Without being bound by theory, it is believed that anhydride groups in the polymer react with, e.g., hydroxyl groups on cellulosic materials such as cotton to covalently link the polymer to the fibers in the fabric.

By "fluorinated polymer" or "fluoropolymer" is meant that the polymer will contain some perfluorinated or partially fluorinated alkyl chains to impart water and oil repellency to coated objects. It may additionally be advantageous for the polymer to contain other groups such as normal alkyl chains; groups that can increase the water solubility or stability of the suspension of the polymer, such as chains of polyethylene glycol or other polar groups; one or more different groups than can crosslink to each other or to the material being coated; or groups that increase polymer flexibility, flame retardancy, the softness of a textile, or resistance to bacteria or mildew.

This invention is further directed to a novel block copolymer containing i) one or more blocks of acrylic acid, methacrylic acid, maleic anhydride, maleic acid, crotonic acid, itaconic acid, or other acid-containing monomers and ii) one or more blocks of a fluorinated monomer that is capable of binding to cotton or other textiles that contain hydroxyl, sulfhydryl, amine or amide groups in the presence of an anhydride-forming catalyst.

In a second embodiment of the invention, the preparations comprise a softener (also referred to herein as a "reactive modifier") durable to repeated laundering. More particularly, the softener preparations of the invention comprise a copolymer or graft copolymer of i) a monomer selected from those containing at least one anhydride functional group or at least one reactive group capable of forming an anhydride functional group, and ii) a soft, elastic, or "rubbery" hydrophobic monomer. The chemical nature of the modifier is compatible with other treatment formulations including, for example, water- and oil-repellent finishes and wrinkle-resistant treatments.

The present invention further provides a softness-imparting composition for fibrous and other substrates, the composition comprising the above softener copolymer together with a catalyst for forming anhydrides from any acid-containing monomers in the copolymer. The resulting reactive anhydride rings bind to substrates, such as textiles and other webs, having free sulfhydryl, alcohol, or amine groups.

This invention is further directed to the yarns, fibers, fabrics, textiles, finished goods, or nonwovens (encompassed herein under the terms "textiles" and "webs") treated with the water- and soil-resistant preparations of the invention. Such textiles and webs exhibit a greatly improved, durable water and soil repellency. By "durable water and soil repellency" is meant that the textile or web will exhibit a repellency or resistance to water and oily soils even after multiple launderings.

This invention is also directed to the yarns, fibers, fabrics, textiles, finished goods, or nonwovens (encompassed herein under the terms "textiles" and "webs") treated with the reactive softener/modifier preparations of the invention. Such textiles and webs exhibit a greatly improved, "durable softness"; that is, they retain a soft hand, even after multiple launderings, while retaining their other desirable properties, such as resistance to wrinkling or water repellency, for example.

Methods are provided for treating fabrics with permanent water/soil repellent coatings and/or softeners.

DETAILED DESCRIPTION OF THE INVENTION

I. Preparations of a Fluoropolymer and an Anhydride-Forming Catalyst

The first textile-reactive preparation of the invention comprises i) a carboxylated fluoropolymer capable of imparting a water/soil-resistant property to textiles and ii) an anhydride-forming catalyst.

The fluorinated monomers or oligomers of the carboxylated water/soil-resistant fluoropolymer are selected from those groups that will provide the necessary water/soil resistance and can be polymerized. Examples include fluorinated monomers of acrylates, methacrylates, alkenes, alkenyl ethers, styrenes, and the like. Monomers that contain carbon-fluorine bonds that would be useful in this invention include, but are not limited to, Zonyl TA-N (an acrylate from DuPont), Zonyl TM (a methacrylate from DuPont), FX-13 (an acrylate from 3M), and FX-14 (a methacrylate from 3M). The fluoropolymers may include —$CF_3$ and —$CHF_2$ end groups, perfluoroisopropoxy groups (—$OCF(CF_3)_2$), 3,3,3-trifluoropropyl groups, and the like. The polymers may include vinyl ethers having perfluorinated or partially fluorinated alkyl chains. The fluoropolymer preferably comprises one or more fluoroaliphatic radical-containing monomers having the structure of Formula I, below:

Formula I

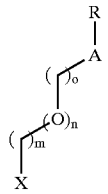

In the compound of Formula I, for example:

m is 0 to 2;

n is 0 or 1;

o is 1 or 2;

A is —$SO_2$—, —N(W)—$SO_2$—, —CONH—, —$CH_2$—, or —$CF_2$—;

R is a linear, branched, or cyclic fluorocarbon, including fully or partially fluorinated hydrocarbons, wherein R may be, for example, a $C_1$ to $C_{30}$ fluorocarbon;

W is hydrogen or $C_1$-$C_4$ lower alkyl; and

X is acrylate ($H_2C{=}CHCO_2$—), methacrylate ($H_2C{=}C(CH3)CO2$-), or a carbon-carbon double bond ($H_2C{=}CH$—).

Particularly useful fluorinated monomers are acrylate and methacrylate monomers with the structures $H_2C{=}CHCO_2CH_2CH_2(CF_2)_nF$ and $H_2C{=}C(CH_3)CO_2CH_2CH_2(CF_2)_nF$, where n in both cases is 1 to 20. More preferably, n lies between approximately 5 and 12, although most commercially available monomers contain a distribution of chain lengths and a few of them may fall outside of this range.

In addition, the fluoropolymer will contain two or more reactive carboxyl groups, at least two of them positioned such that they could form a 5- or 6-membered anhydride ring under appropriate conditions and in the presence of a catalyst that will act to create reactive anhydrides from the adjacent carboxyl groups. For example, the reactive monomers may be selected from groups that contain carboxylates such as acrylic acid, methacrylic acid, bisacrylamidoacetic acid, 3-butene-1,2,3-tricarboxylic acid, maleic acid, 2-carboxyethyl acrylate, itaconic acid, 4-vinylbenzoic acid, and the like. Particularly useful monomers, oligomers, or polymers are those that have carboxyl-containing monomers copolymerized with at least some fluorinated monomers or polymers.

In a presently preferred embodiment of this invention, one or more surfactants will be present during the polymerization and with the dissolved or suspended polymer. The surfactant will keep water-insoluble monomers in solution during polymerization, and later to keep the entire polymer in solution. Presently preferred are the non-ionic surfactants, such as those with the structures $CH_3(CH_2)_nCO(OCH_2CH_2)_mOH$ (such as, for example, polyethylene oxide (14) monostearate, $CH_3(CH_2)_n(OCH_2CH_2)_mOH$, and those with trade names that include "Tween", or "Triton".

It is also possible to add additional monomers into the polymer. These monomers may act as dyes, pH indicators, softeners, compounds that would give the textile resistance to fungi or bacteria, spacers to make the polymer more flexible, components to increase the solubility of the polymer in a carrier solvent system (e.g., mixtures of water, polar organic solvents, and surfactants) from which the polymer is deposited onto the textiles, or components (non-fluorinated) that add hydrophobicity. Such monomers are known to those of skill in the art. Examples of potential softeners that could soften the polymer and are commercially available include acrylic acid and methacrylic acid esters of alkyl chains or siloxane oligomers or polymers.

Anhydride-forming catalysts that can be employed in the preparations of the present invention include, but are not limited to, alkali metal hypophosphites, alkali metal phosphites, alkali metal polyphosphates, and alkali metal dihydrogen phosphates. Some examples of such catalysts are $NaH_2PO_2$, $H_3PO_2$, $Na_3PO_4$, $Na_2HPO_4$, $NaH_2PO_4$, and $H_3PO_4$.

The present invention is further directed to the yarns, fibers, fabrics, finished goods, or other textiles (encompassed herein under the terms "textiles" and webs") treated with the permanent or substantially durable water/soil-resistant fluoropolymer. These textiles or webs will display comparable textile performance of the untreated textile without the wetting/staining of traditional textiles.

These textiles can be used in a variety of ways including, but not limited to various articles of clothing, including informal garments, daily wear, workwear, activewear and sportswear, especially those for, but not limited, to easily wet or stained clothing, such as formal garments, coats, hats, shirts, pants, gloves, and the like; other textiles subject to wetting or staining, such as interior furnishings and upholstery therefor, carpets, awnings, draperies, upholstery for outdoor furniture, protective covers for barbecues and outdoor furniture, automotive and recreational vehicle upholstery, sails for boats, and the like; and industrial uses, such as those listed in Adanur, S., *Wellington Sears Handbook of Industrial Textiles*, pp. 8–11 (Technomic Publishing Co., Lancaster, Pa., 1995).

The durable water/soil-resistant webs of the present invention are intended to include fabrics and textiles, and may be a sheet-like structure (woven, knitted, tufted, stitch-bonded, or non-woven) comprised of fibers or structural elements. Included with the fibers can be non-fibrous elements, such as particulate fillers, binders, sizes, and the like. The textiles or webs include fibers, woven and non-woven fabrics derived from natural or synthetic fibers or blends of such fibers, as well as cellulose-based papers, and the like. They can comprise fibers in the form of continuous or discontinuous monofilaments, multifilaments, staple fibers, and yarns containing such filaments and/or fibers, which fibers can be of any desired composition. The fibers can be of natural, manmade, or synthetic origin. Mixtures of natural fibers, manmade fibers, and synthetic fibers can also be used. Examples of natural fibers include cotton, wool, silk, jute, linen, and the like. Examples of man-made fibers include regenerated cellulose rayon, cellulose acetate and regenerated proteins. Examples of synthetic fibers include polyesters (including polyethyleneterephthalate and polypropyleneterephthalate), polyamides (including nylon), acrylics, olefins, aramids, azlons, modacrylics, novoloids, nytrils, aramids, spandex, vinyl polymers and copolymers, vinal, vinyon, Kevlar®, and the like.

To prepare the durable water/soil-resistant webs, the fiber, the yarn, the fabric, or the finished good containing free hydroxyl groups is exposed (by methods known in the art such as by soaking, spraying, dipping, fluid-flow, padding, and the like) to an aqueous solution of the carboxyl-containing water/soil-resistant fluoropolymer and the anhydride-forming catalyst, in a one-step process. The catalyst will form reactive anhydrides from adjacent carboxyl groups on the fluoropolymer, which resulting anhydrides will react with hydroxyl groups on the web by coordinate bonding to permanently attach to the web. The treated web is then removed from the solution, padded and cured. The web may then be rinsed in water to remove any excess catalyst and polymer and dried to give the durable water- and soil-repellent textiles and webs of the invention.

The process temperature can vary widely. However, the temperature should not be so high as to decompose the reactants or so low as to cause inhibition of the reaction or freezing of the solvent. Unless specified to the contrary, the processes described herein take place at atmospheric pressure over a temperature range from ambient temperature to an elevated temperature that is below the boiling point of the solvent used, preferably from about 10° C. to about 110° C., more preferably from about 20° C. to about 60° C., and most preferably at 20° C. Conveniently, the processes will be at ambient temperature. The time required for the processes herein will depend to a large extent on the temperature being used and the relative reactivities of the starting materials. Therefore, the time of exposure of the textile to the catalyst and the polymer in solution can vary greatly, for example from about a few seconds to about two hours. Normally, the exposure time will be from a few seconds to ten minutes. Curing usually takes place at approximately 160° C. for about 5 minutes or less. Drying is carried out at ambient temperature or at a temperature above ambient, up to about 220° C. The pH of the solution should be less than 7, but not so low as to significantly deteriorate the fabric, to allow formation of the anhydride group. PH of 4.5 is preferred. Salts (such as, for example, NaCl, $Na_2SO_4$, etc.) may optionally be added to increase the rate of adsorption of anionic polymers onto the fibers. Unless otherwise specified, the process times and conditions are intended to be approximate.

This invention is further directed to a diblock copolymer that contains one or more blocks of an acidic monomer, such as acrylic acid, along with one or more blocks of fluorinated monomers that are capable of binding to cotton or other textiles that contain hydroxyl, sulfhydryl, amine or amide groups in the presence of an anhydride-forming catalyst. This polymer is useful to coat fabrics using an anhydride-forming catalyst. In a presently preferred embodiment, the hydrophilic monomers are concentrated to one end of the macromolecule. It is believed that this will increase its water solubility and improve its ability to bind to fabrics.

The synthesis of the copolymer comprises the steps of:

1) Polymerizing FX-13, Zonyl TA-N, or another monomer that does not contain a carboxyl group in the presence of a chain transfer agent that contains a sulfhydryl group and an amine group, one example being, but the invention not limited to, $HS(CH_2)_nNH_2$ (where n=2–20). Two commercially available compounds that have amino and thiol groups are 1-amino-2-methyl-2-propanethiol (sold by Aldrich as the hydrochloride) and 2-(butylamino)ethanethiol.

2) Reacting the amine-terminated polymer produced in Step 1) with a compound (such as N-acetyl homocysteine thiolactone or 2-iminothiolane, for example) that will convert the amine-terminated polymer into a sulfhydryl-terminated polymer.

3) Performing a polymerization in the presence of the sulfhydryl-terminated polymer produced in Step 2) with a monomer different from the monomer used in Step 1). Thus, the sulfhydryl-terminated polymer generated in Step 2) acts as a chain transfer agent for the polymer created in Step 3) and caps it, creating a block copolymer.

A graft copolymer may be made, where the grafted portion is either carboxyl groups or fluorinated material or another material. It is also possible to make a polymer composed entirely or in part of monomers that are themselves oligomers.

The resulting copolymer will contain two or more carboxyl groups, at least two of them positioned such that they could form a 5- or 6-membered anhydride ring in the presence of an anhydride-forming catalyst.

II. Preparations of a Reactive Modifier Softener, with or without an Anhydride-Forming Catalyst The second reactive textile finish of the invention comprises a copolymer or graft copolymer of i) a monomer selected from those containing at least one anhydride functional group or a reactive group capable of forming an anhydride functional group, and ii) a soft, elastic, or "rubbery" hydrophobic monomer, oligomer or polymer. When the copolymer comprises a group capable of forming an anhydride functional group, the preparation further comprises an anhydride-forming catalyst. This copolymeric finish is capable of imparting a soft hand and tear/abrasion resistance to textiles.

The monomer as component (i) of the present copolymer is selected from those monomers that contain an anhydride functional group or a reactive group capable of forming an anhydride functional group. Such monomers can include carboxylic acids and carboxylic acid anhydrides and can be, but are not limited to, maleic acid, maleic anhydride, acrylic acid, itaconic acid, bisacrylamidoacetic acid, 3-butene-1,2,3-tricarboxylic acid, 2-carboxyethyl acrylate, methacrylic acid, acrylic anhydride, allylsuccinic anhydride, citraconic anhydride, methacrylic anhydride, 4-methacryloxyethyl trimellitic anhydride, 4,4'-hexafluoro-isopropylidenebisphthalic anhydride, and the like. The monomer is copolymerized or grafted in such a proportion as to take about 0.2% to about 40% by weight, preferably about 5% to about 20% by weight, of the copolymer of this invention. When the resulting copolymer is functionalized by carboxylates, it is preferred that it contain two more such groups, at least two of which are positioned such that they could form a 5- or 6-membered anhydride ring in the presence of an anhydride-forming catalyst.

The rubbery groups as component (ii) of the reactive modifier copolymer are selected from those groups that will provide the necessary softness and tear/abrasion resistance. Examples include monomers, oligomers or polymers of isoprene, chloroprene, butadiene, ethylene, isopropylene, ethyleneoxide, isobutylene, propylene, chlorinated ethylene, and polymers such as polydimethylsiloxane, polyisobutylene, poly-alt-styrene-co-butadiene, poly-random-styrene-co-butadiene, etc., and copolymers of all of these. The rubbery group is copolymerized in such a proportion as to take about 60% to about 99.8% by weight, preferably about 80% to about 95% by weight, of the copolymer of this invention.

It is also possible to add additional monomers into the polymer. These monomers may act as dyes, pH indicators, compounds that would give the textile resistance to fungi or bacteria, spacers to make the polymer more flexible, components to increase the solubility of the polymer in a carrier solvent system (e.g., mixtures of water, polar organic solvents, and surfactants) from which the polymer is deposited onto the textiles, or components (fluorinated or non-fluorinated) that add hydrophobicity.

Anhydride-forming catalysts that can be employed in the preparations of the present invention include, but are not limited to, alkali metal hypophosphites, alkali metal phosphites, alkali metal polyphosphates, and alkali metal dihydrogen phosphates. Some examples of such catalysts are $NaH_2PO_2$, $H_3PO_2$, $Na_3PO_4$, $Na_2HPO_4$, $NaH_2PO_4$, and $H_3PO_4$.

The anhydride functional group will bind chemically with any substrate (including a particular fiber, yarn, fabric, or finished good) with available primary or secondary amines, hydroxyls, sulfhydryls, or metal oxides. For example, cellulosic-based webs such as paper, cotton, rayon, linen, and jute contain hydroxyls. Wool, which is a proteinaceous animal fiber, contains hydroxyls, amines, carboxylates, and thiols (disulfides).

In a presently preferred embodiment, the durable softener preparation comprises maleinized polybutadiene, which can have varying degrees of maleinization, molecular weight, 1,2-vinyl content, and viscosity. The present copolymer can be prepared according to various well-known methods, preferably by solution polymerization or by emulsion polymerization. Its preparation is illustrated below:

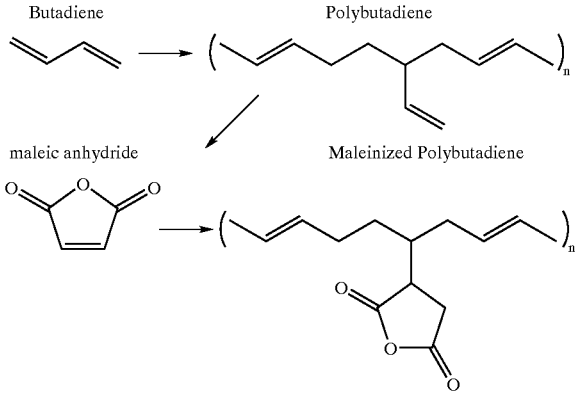

One such maleinized polybutadiene copolymer is commercially available through Ricon Resins Inc. (Grand Junction, Colo.).

Using various surfactants, preferably a non-ionic surfactant, an anionic surfactant, or a mixture thereof, stable aqueous dispersions of the reactive modifier polymer may be prepared under basic conditions, with heat and high shear forces. Although water solubility or dispersability is desired, this requirement is not an absolute necessity. Precursors or copolymers that can be dissolved in organic solvents (such as tetrachloroethylene, TCE) can be particularly useful for treating wool, cotton, and other solvent resistant webs.

The present invention is further directed to the yarns, fibers, fabrics, textiles, or finished goods (encompassed herein under the terms "textiles" and "webs") treated with the durable softener preparation. These novel textiles or webs will display a soft hand and improved tear/abrasion resistance.

The novel webs of the present invention are intended to include fabrics and textiles, and may be a sheet-like structure (woven, knitted, tufted, stitch-bonded, or non-woven) comprised of fibers or structural elements. Included with the fibers can be non-fibrous elements, such as particulate fillers, binders, sizes, and the like. The textiles or webs include fibers, woven and non-woven fabrics derived from natural or synthetic fibers or blends of such fibers, as well as cellulose-based papers, and the like. They can comprise fibers in the form of continuous or discontinuous monofilaments, multifilaments, staple fibers, and yarns containing such filaments and/or fibers, which fibers can be of any desired composition. The fibers can be of natural or synthetic origin. Mixtures of natural fibers and synthetic fibers can also be used. Examples of natural fibers include cotton, wool, silk, jute, linen, and the like. Examples of man-made fibers include regenerated cellulose rayon, cellulose acetate, and regenerated proteins. Examples of synthetic fibers include polyesters (including polyethyleneglycolterephthalate), polyamides (including nylon), acrylics, olefins, aramids, azlons, modacrylics, novoloids, nytrils, spandex, vinyl polymers and copolymers, vinal, vinyon, and the like.

The composition of the present copolymer is applied to the material to be treated as a solution or dispersion/emulsion by methods known in the art such as by soaking, spraying, dipping, fluid-flow, padding, and the like. Reactive groups on the copolymer react with the fibrous material, by covalent bonding, to attach to the material. This reaction (curing) can take place before, during or after the treated textile is dried, although it is generally preferred that the cure occur after the drying step.

In applying the copolymer composition of the invention to the web to be treated, the pH range should be chosen to be compatible with the reactants. The process (cure) temperature can vary widely, depending on the reactivity of the reactants. However, the temperature should not be so high as to decompose the reactants or so low as to cause inhibition of the reaction or freezing of the solvent. Unless specified to the contrary, the curing process described herein takes place at atmospheric pressure over a temperature range from about 110° C. to about 250° C. The time required for the processes herein will depend to a large extent on the temperature being used and the relative reactivities of the starting web and water-repellent polymeric composition. Unless otherwise specified, the process times and conditions are intended to be approximate.

EXAMPLES

Example 1

Application of Fluoropolymer Solution to Cotton

Polymer solution preparation: 9.06 g 95% water/5% isobutanol, 1.04 g 1 M NaOH, and 1.0 g of fluoropolymer were mixed together in THF. The polymer was about 40 wt. % of the solution. The polymer composition was: 3:1 acrylic acid:FX-13 polymer, 1% mercaptosuccinic acid ("100-mer"). The polymer completely dissolved. 1450 $\mu$L of dilute acid (4.15 g 50% $H_3PO_2$ in water in 40.02 g water) was added slowly while the polymer solution was stirred, reducing the pH to 3.42. This solution was padded onto 2 cotton samples, which were dried in an oven at 90° C. and then cured for 5 and 15 minutes at 160° C. The samples were placed in a rotowash for 45 minutes (equivalent of 5 home launderings). They were then rinsed for 1 minute in flowing tap water and finally dried at 90° C.

Both samples had the same results in tests for repellency: Water beaded up on them. 81 % Methanol in water (27.1 dynes/cm) beaded up. Decane wet the samples. Dodecane beaded up.

Example 2

Since softness is very subjective and not easy to measure, the durability of the finish was determined by observing the hydrophobicity of the cotton. By placing a drop of water on the treated surface, it is possible to measure the time it takes for the drop to completely soak into the material. This is referred to as the time to wet (TTW). Untreated cotton fabric wets instantly (TTW<1 second), while polybutadiene-treated fabric generally exhibits hydrophobicity (TTW>10 seconds). It has been noticed that when there is evidence of hydrophobicity on the cotton surface, the cotton is softer and more supple than the untreated fabric.

An aqueous dispersion of Ricon 130MA8 maleinized polybutadiene (Ricon Resins, Inc., Grand Junction, Colo.) was prepared at a concentration of 2% polymer (by weight) with 1 % catalyst (sodium hypophosphite) at a pH of 4.5. A 7.5-oz bleached white twill-weave cotton fabric was dipped into the solution and padded to approximately 70% wet pick-up. The fabric was then cured in an oven at 150° C. for 5 minutes. The resulting fabric was soft (as compared to the untreated control) and hydrophobic (see graph below). The treated sample was washed repeatedly, and the softness as well as the hydrophobicity was measured after certain intervals. Specifically, a square piece of fabric (approximately 8"×8") was placed in a standard home washing machine and the manufacturer-recommended amount of Tide® laundry detergent was added. This is a "home laundering" (HL). The samples were washed with warm water on the "normal" wash and spin cycles. After 20 HLs, the fabric was still noticeably softer than the untreated washed control and the fabric retained its hydrophobicity, demonstrating that the polymer treatment remains on the fabric.

TABLE I

Time of water drop to completely wet fabric after multiple home launderings.

| # of Home Launderings | Treated Fabric | Untreated Control |
|---|---|---|
| 0 HL | >6O sec | Instant (<1 sec) |
| 1 HL | >60 sec | Instant (<1 sec) |
| 5 HL | >60 sec | Instant (<1 sec) |
| 10 HL | >60 sec | Instant (<1 sec) |
| 15 HL | >60 sec | Instant (<1 sec) |
| 20 HL | >60 sec | Instant (<1 sec) |

Example 3

Fabric treated similarly to Example 1 was tested for abrasion resistance using the ASTM D3885-92 "Standard Test Method for Abrasion Resistance of Textile Fabrics (Flexing and Abrasion Method)" with 1 pound load, 4 pound tension. The results are included in the table below:

TABLE 2

| Sample | Flex Abrasion Cycles (warp × fill) |
|---|---|
| Treated | >1000 × >1000 |
| Untreated | 240 × 220 |

What is claimed is:

1. A preparation for treating a textile, the preparation comprising i) a polymer that contains two or more reactive carboxyl groups, at least two of them positioned such that they may form a 5- or 6-membered anhydride ring, wherein said polymer is a fluorinated polymer; and ii) an anhydride-forming catalyst.

2. The preparation according to claim 1 wherein said fluorinated polymer comprises one or more fluorinated monomers of the structure:

Formula I

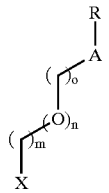

wherein m is 0 to 2;

n is 0 or 1;

o is 1 or 2;

A is —$SO_2$—, —N(W)—$SO_2$—, —CONH—, —$CH_2$—, or —$CF_2$—;

R is a linear, branched, or cyclic fully- or partially-fluorinated hydrocarbon;

W is hydrogen or $C_1$–$C_4$ lower alkyl; and

X is acrylate ($H_2C{=}CHCO_2$—), methacrylate ($H_2C{=}C(CH_3)CO_2$—), or a carbon—carbon double bond ($H_2C{=}CH$—).

3. A preparation for treating a textile, the preparation comprising i) a polymer that contains two or more reactive carboxyl groups, at least two of them positioned such that they may form a 5- or 6-membered anhydride ring; and ii) an anhydride-forming catalyst, wherein said polymer is a softener comprising rubbery hydrophobic groups.

4. The preparation according to claim 3 wherein said rubbery hydrophobic groups are selected from the group consisting of monomers, oligomers and polymers of isoprene, chloroprene, butadiene, ethylene, isopropylene, etheyleneoxide, isobutylene, propylene, chlorinated ethylene, polydimethylsiloxane, polyisobutylene, poly-alt-styrene-co-butadiene, poly-random-styrene-co-butadiene, and mixtures and copolymers thereof.

5. A preparation for treating a textile, the preparation comprising a copolymer of i) fluorinated monomer that contains an anhydride functional group and ii) a rubbery hydrophobic group.

6. The preparation according to claim 5 wherein said rubbery hydrophobic group is selected from the group consisting of monomers, oligomers and polymers of isoprene, chloroprene, butadiene, ethylene, isopropylene, ethyleneoxide, isobutylene, propylene, chlorinated ethylene, polydimethylsiloxane, polyisobutylene, poly-alt-styrene-co-butadiene, poly-random-styrene-co-butadiene, and mixtures and copolymers thereof.

* * * * *